US005725397A

United States Patent [19]

Fukamachi et al.

[11] Patent Number: 5,725,397

[45] Date of Patent: Mar. 10, 1998

[54] DIVISIONAL TYPE CONNECTOR

[75] Inventors: Makoto Fukamachi; Satoru Nishide, both of Yokkaichi, Japan

[73] Assignee: Sumitomo Wiring Systems, Ltd., Japan

[21] Appl. No.: 510,271

[22] Filed: Aug. 2, 1995

[30] Foreign Application Priority Data

Aug. 9, 1994 [JP] Japan ..... 6-209235

[51] Int. Cl.[6] ..... H01R 13/502

[52] U.S. Cl. ..... 439/701; 439/596; 439/902

[58] Field of Search ..... 439/701, 372, 439/347, 864, 540.1, 596, 686, 695, 586, 717, 902, 157

[56] References Cited

U.S. PATENT DOCUMENTS

| | | | |
|---|---|---|---|
| 3,824,553 | 7/1974 | Glover et al. | 439/717 |
| 4,674,814 | 6/1987 | Hashino et al. | 439/701 |
| 5,108,313 | 4/1992 | Adams | 439/701 |
| 5,378,173 | 1/1995 | Hashizawa | 439/701 |
| 5,421,746 | 6/1995 | David | 439/701 |
| 5,551,885 | 9/1996 | Yamanashi et al. | 439/372 |

FOREIGN PATENT DOCUMENTS

| | | | |
|---|---|---|---|
| 0 316 687 | 5/1989 | European Pat. Off. . | |
| 0 323 771 | 7/1989 | European Pat. Off. . | |
| 0 429 340 A1 | 5/1991 | European Pat. Off. . | |
| 4-274180 | 9/1992 | Japan . | |
| 6-36242 | 5/1994 | Japan . | |
| 8867/64 | 7/1964 | Switzerland | 439/701 |

*Primary Examiner*—Neil Abrams
*Assistant Examiner*—Brian J. Biggi
*Attorney, Agent, or Firm*—Banner & Witcoff, Ltd.

[57] ABSTRACT

A plastic frame 13 for electrical connectors has an open end 14. A closing plate 18 of plastic is connected to one side of the open end by means of a living hinge. A cover 24 for covering electrical wires is integrally formed on the upper side of the frame 13. During assembly, the closing plate 18 is opened and each connector 1 is inserted into the frame 13 by sliding protruding members 11 along guiding grooves 15. Then the closing plate 18 is closed and latched. The electrical wires coming out of the connector 1 are simultaneously collected together under the cover 24. For disassembly, the closing plate 18 can be unlatched and each connector pulled out one by one.

16 Claims, 6 Drawing Sheets

DIVISIONAL TYPE CONNECTOR

TECHNICAL FIELD

The present invention relates to an improved divisional type connector comprising a partitioned electrical connector assembly.

BACKGROUND TO THE INVENTION

Partitioned connector assemblies came into use, for example, for multiple-terminal connectors which have several dozen terminals, in order to prevent terminals from being inserted into the wrong connector, and other problems. They permit terminals to be inserted into a frame in groups. Such conventional partitioned connector assemblies have a plurality of separate connectors, each of which has a small number of terminals. Further, such assemblies are provided with a unified frame which has the same number of connector insertion slots as there are connectors. In use, one connector is introduced into each insertion slot and a stopping member provided in each insertion slot is used to lock each connector in place.

However, in conventional partitioned connector assemblies, when each connector is removed from the frame for purposes of maintenance etc., each of the stopping members provided in the frame has to be removed one by one. This is a troublesome procedure.

Furthermore, in such multiple terminal connectors, a plurality of electrical wires coming out from the connectors are collected together and are arranged to follow a given direction. These electrical wires are then sheathed by a cover for protection and convenience of handling. However, in the conventional partitioned connector assemblies, the cover is not part of the frame but is provided separately so that the cover has to be placed on the frame over the electrical wires after the wires have been collected together. As a result, there is a danger of the cover not sitting properly on the frame due to stray wires being trapped between the frame and the sides of the cover, and the possibility of damage to wires trapped in this way. The present invention has been developed after taking onto consideration these problems.

SUMMARY OF THE INVENTION

According to the invention there is provided a connector assembly comprising a frame defining a frame opening, a closure member for the frame opening, and a plurality of electrical connectors insertable in the frame through said frame opening, the frame and connectors having co-operating register members adapted to engage and guide said connectors one by one into the frame.

The invention gives significantly simpler operability during maintenance since, during disassembly, it suffices to open the closing plate and then to take out each connector one by one.

The closure member preferably comprises a gate hinged to the frame and including a releasable latch to engage the frame on closure of the gate. Preferably frame and gate are moulded integrally in plastic and connected by a living hinge.

Preferably the register members comprise a sliding connection such as one or more protruding members and groove; such an arrangement enables the connectors to freely slide into position and be held in the frame. The frame may include a latching detent to retain one or more connectors in the frame.

In a preferred embodiment the frame includes an integral cover to shield the connection wires of the connectors.

Thus as each connector is inserted into the frame, its electrical wires pass under and are automatically guided and protected by the cover. It is therefore no longer necessary to place a separate cover on the frame, and this arrangement has the further advantage that the electrical wires do not get trapped between the frame and the cover as can happen in the case of the conventional casing. The cover ensures that the connector wires are automatically guided in the exit direction. Moreover, there is another advantage that the production cost can be lowered since the number of parts is reduced.

BRIEF DESCRIPTION OF THE DRAWINGS

Other features of the invention will be apparent from the following description of two preferred embodiments of the invention shown by way of example only in the accompanying drawings, in which

FIG. 4 is a vertical cross-section corresponding to

FIG. 3 and illustrating the connectors within the frame;

DESCRIPTION OF THE PREFERRED EMBODIMENTS

FIGS. 1 to 8 show the first embodiment, and represent the case where the present invention is used for female partitioned lever-type connectors.

Figure 1:
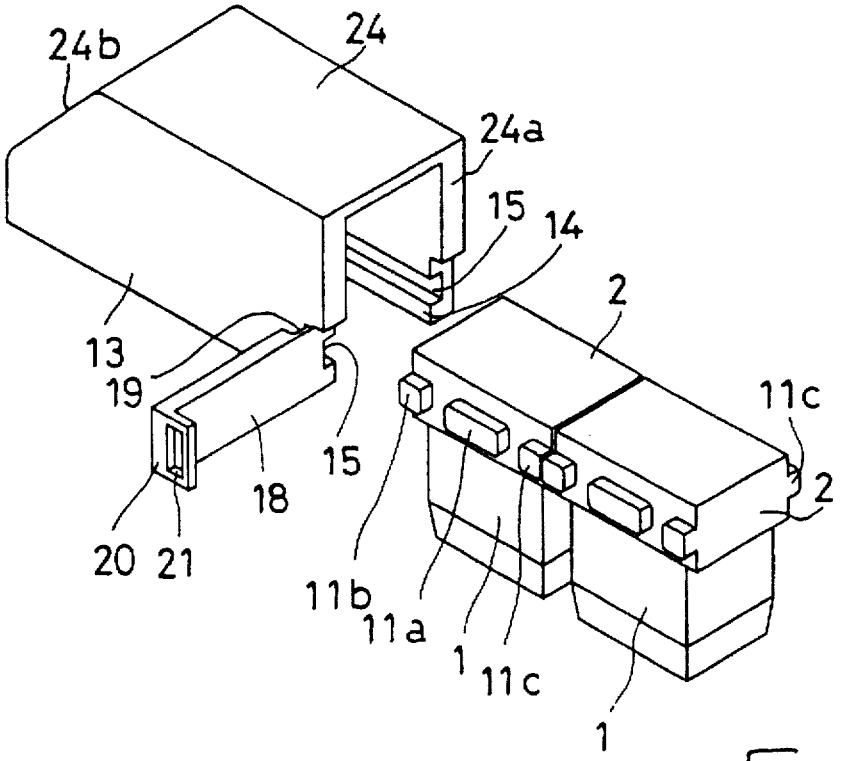
FIG. 1 is a schematic isometric view of the first embodiment of the present invention showing the pre-assembly state.
Figure 2:
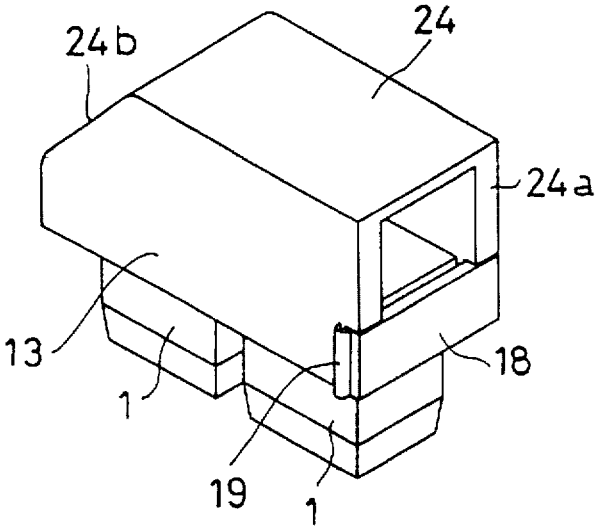
FIG. 2 is a schematic isometric view showing the post-assembly state of the first embodiment of the present invention.

In FIG. 1, numeral 1 designates a partitioned female connector. Two such connectors of the same shape are shown. Each female connector 1 is rectangular and has a wider end member 2 at the upper end thereof.

Figure 8:
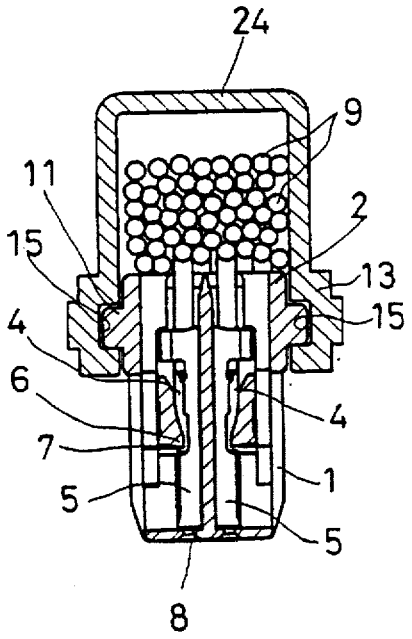
FIG. 8 is a cross-section along line VIII—VIII of FIG. 4.

As shown in FIG. 8, each female connector 1 has a plurality of cavities 4 formed in two rows, left and right, vertically oriented in the direction of the insertion of terminals. A female terminal 5 is inserted into each cavity 4 from above so that each of the female terminals 5 inserted in the left hand row is positioned back to back with respect to the corresponding female terminal 5 inserted in the right hand row. Further, each female terminal 5 is pushed fully into the cavity 4 so that the end of each female terminal 5 touches the bottom wall of the respective cavity 4.

A lance 6 provided in the cavity 4 engages a stopping recess of the respective terminal. Together, the bottom wall of the cavity 4 and the lance 6 ensure that each female terminal 5 is held immobile in its corresponding cavity 4. Moreover, a through hole 8 is provided in the bottom wall of each cavity 4 through which the tab (not shown) of the corresponding female terminal 5 passes. The electrical wires 9 connected to each female terminal 5 are arranged to come out from the upper end of the female connectors 1.

Three protruding members 11 are aligned on the left side face of the end member 2 of each female connector 1, and a further three protruding members 11 are similarly aligned on the right side face thereof. The protruding member 11*a* is medially located in the length-wise direction between the protruding members 11*b* and 11*c* which are located at the extreme ends of the side faces of the female connector 1. The protruding member 11*a* is relatively long compared to the protruding members 11*b* and 11*c*, as illustrated.

Figure 4:
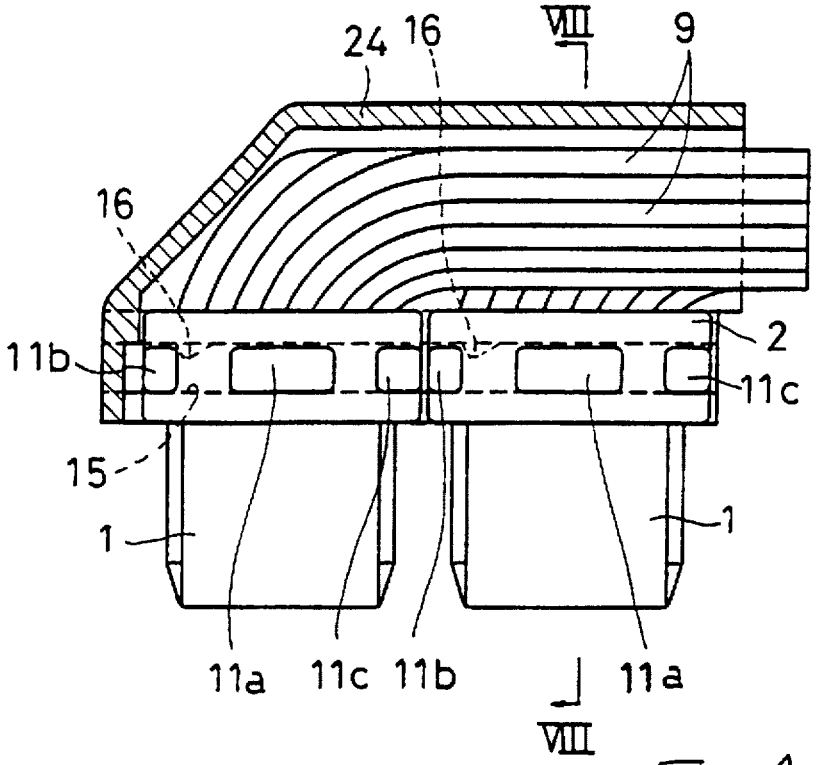
Figure 5:
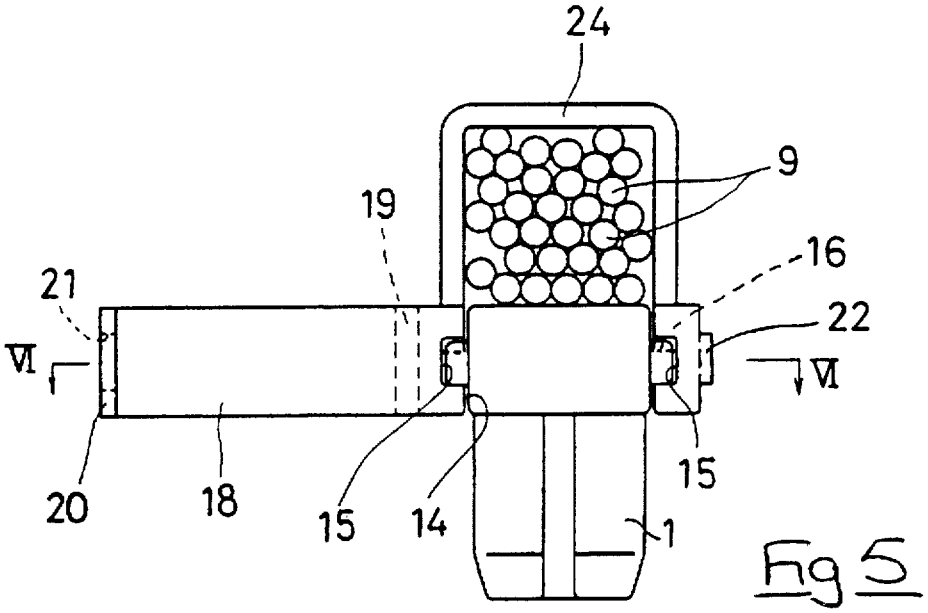
FIG. 5 is a side view from the right of the assembly shown in FIG. 4.

13 is a frame into which the female connectors 1 are inserted. The frame 13 has a rectangular cross-section so as to permit insertion therein of the end member 2 of each connector 1. The frame 13 has an open end 14, and guiding grooves 15 are formed on the left and right inner side faces of the frame 13. These guiding grooves 15 extend to the open end 14 of the frame 13 and allow the protruding members 11 of the female connector 1 to be freely slidable therein. Further, as shown in FIG. 4, stopping members 16 are provided on the inner upper face of each guiding groove 15. Each stopping member 16 engages a respective protruding member 11*b* which is located at the front end of each female connector 1 (with respect to the insertion direction) in the manner of a detent.

A closing plate 18 is fixed to one side of the open end 14 of the frame 13. The frame 13 and closing plate 18 are preferably moulded in one piece in plastic, the frame being opened and closed by means of a self or living hinge 19. A locking plate 20 is formed at a right angle on the extreme outer edge of the closing plate 18. When the closing plate 18 is closed, a window 21 of the locking plate 20 engages a locking member 22 which is provided on the outer surface of the frame 13 (see FIG. 5).

A cover 24 is integrally formed on the frame 13 so as to cover its upper face. The rear face 24*a* of the cover 24 is open along the open end 14 of the frame 13. The rear face 24*a* projects out from the open end 14 of the frame 13 to an extent corresponding to the thickness of the closing plate 18 so as to give a flush finish. The front face 24*b* of the cover 24 is formed diagonally so as to allow for the movement of a lever provided on a corresponding male frame (not shown).

Operation of this embodiment is explained below.

Figure 3:
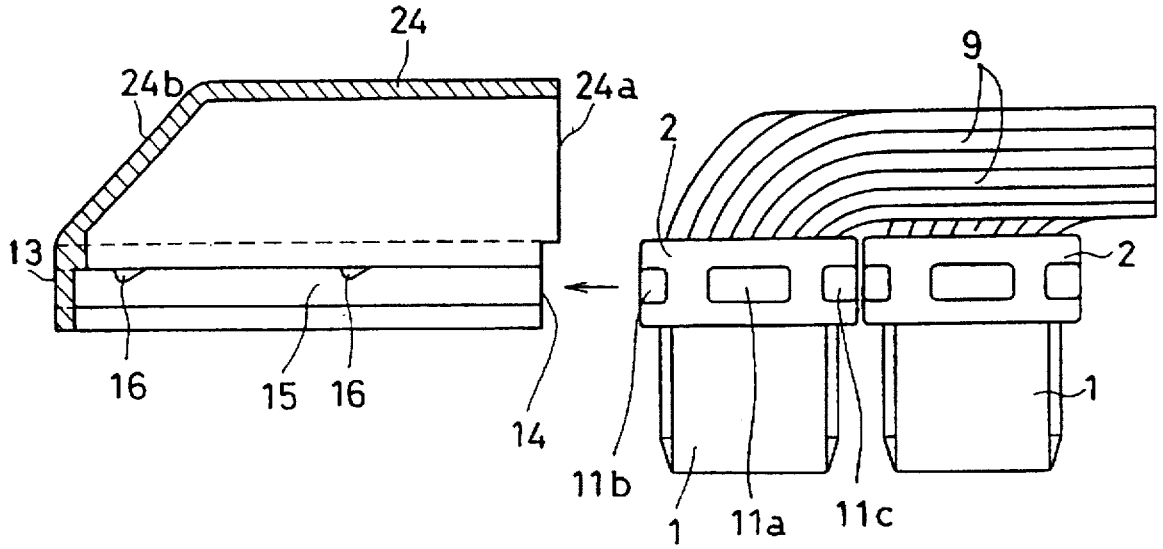
FIG. 3 is an exploded view of the assembly operation.

During assembly, first the female terminals 5 are fitted into each female connector 1. The closing plate 18 of the frame 13 is kept open. Then, the electrical wires 9 coming out from the first female connector 1 are collectively drawn out in the rear direction and, as shown in FIG. 3, the protruding members 11 of the female connector 1 are engaged with the guiding grooves 15 from the open end 14, thereby allowing the female connector 1 to slide into the frame 13. The protruding members 11*a*, 11*b*, 11*c* located both on the right and left sides of the female connector 1 are successively pushed past the stopping members 16 provided towards the open end of the guiding grooves 15. As shown in FIG. 4, when the female connector 1 is pushed in so that it comes into contact with the inner face of the frame 13, the foremost protruding member 11*b* passes beyond the corresponding stopping member 16 and the rear face of the protruding member 11*b* is thereby held against movement. As a result, the female connector is retained and cannot move accidentally. Simultaneously, the electrical wires 9 get bundled together under the cover 24.

Similarly, the electrical wires 9 coming out from the second connector 1 are then collectively drawn out in the rear direction and the protruding members 11 of the second female connector 1 are engaged in the guiding grooves 15 from the open end 14, thereby allowing the connector to slide into the frame 13. The electrical wires 9 coming out from the previously inserted female connector 1 are pushed towards the upper side of the cover 24. Then, the second female connector 1 is pushed forward until it comes into contact with the previously inserted first female connector 1 and the outermost protruding members 11*b* of the second female connector 1 pass beyond the corresponding stopping members 16 to retain the second connector against removal. Simultaneously, the electrical wires 9 coming out from the second connector 1 get bundled together under the cover 24 below the electrical wires 9 of the first connector 1.

Figure 6:
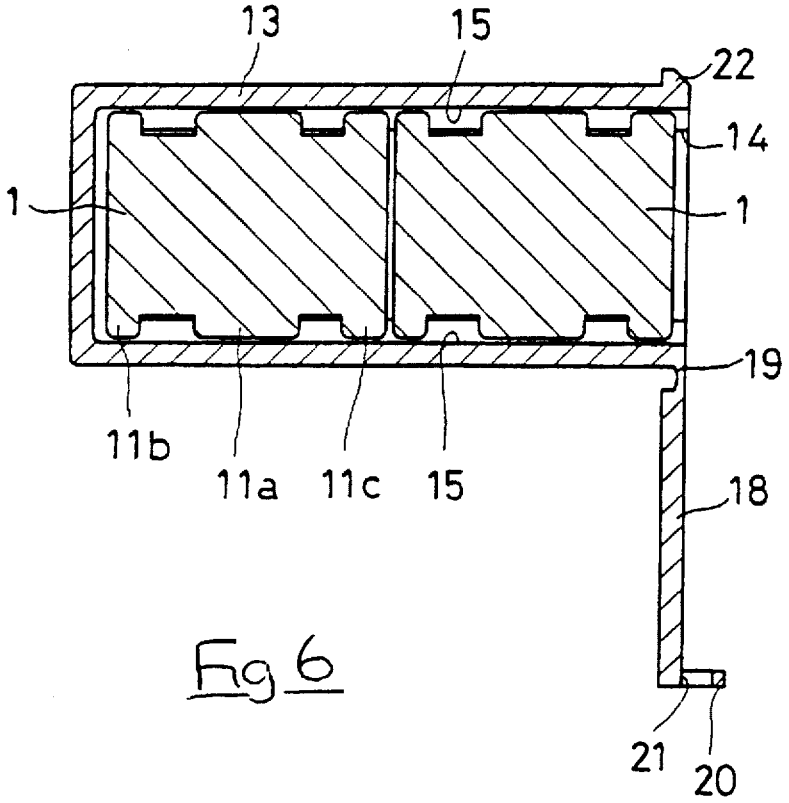
FIG. 6 is a cross-section along line VI—VI of FIG. 5.
Figure 7:
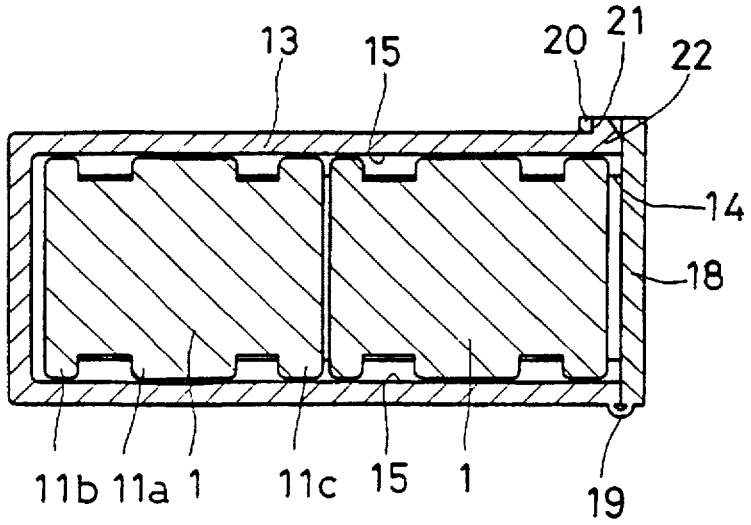
FIG. 7 is a cross-section similar to FIG. 6 and showing the closing plate in the closed state.

As shown in FIG. 6, after the two female connectors 1 are inserted into the frame 13, the closing plate 18 which was hitherto open is now closed. The locking plate 20 undergoes elastic deformation in the outward direction as it passes over the locking member 22, and then, as shown in FIG. 7, the locking plate 20 reverts to its original form as the locking member 22 engages the window 21. The closing plate 18 now forms a single surface with the rear face 24*a* of the cover 24 and the open end 14 of the frame 13 is closed. The closing plate 18 remains locked in this state. In this manner, the two female connectors 1 are inserted into the frame 13 and securely retained against removal.

Although not shown in the figures, two male connectors with male terminals fitted therein are inserted into a unified male frame in the same way as described above. A follower pin (not shown) projecting from the female frame fits into a cam groove formed in a lever pivoted on the male frame. Operating the lever causes the female frame 13 to be pulled towards the male frame, thereby connecting the male and female terminals of the corresponding male and female connectors. During disassembly for maintenance or other purposes, the lever is moved in the opposite direction and then the follower pin is separated from the cam groove. Then the male and female frames are disengaged. After that, the female frame 13 can be opened as shown in FIG. 6 by opening the closing plate 18. Subsequently the two female connectors 1 can be pulled out by resiliently overcoming the detent force of the respective stopping member 16. The male connectors are disassembled in the same way.

Thus each female connector can be removed one by one from the frame, thereby resulting in significantly improved operability during maintenance.

Furthermore, as each female connector 1 is inserted into the frame 13, its electrical wires 9 pass under and are automatically protected by the cover 24. Consequently, it is no longer necessary to place a cover on the frame, and furthermore there is no cover separate from the frame. This results in improved operability during assembly. The possibility of trapping electrical wires between the frame and the cover is eliminated. Production and assembly costs can be reduced since the number of parts is reduced.

Figure 9:
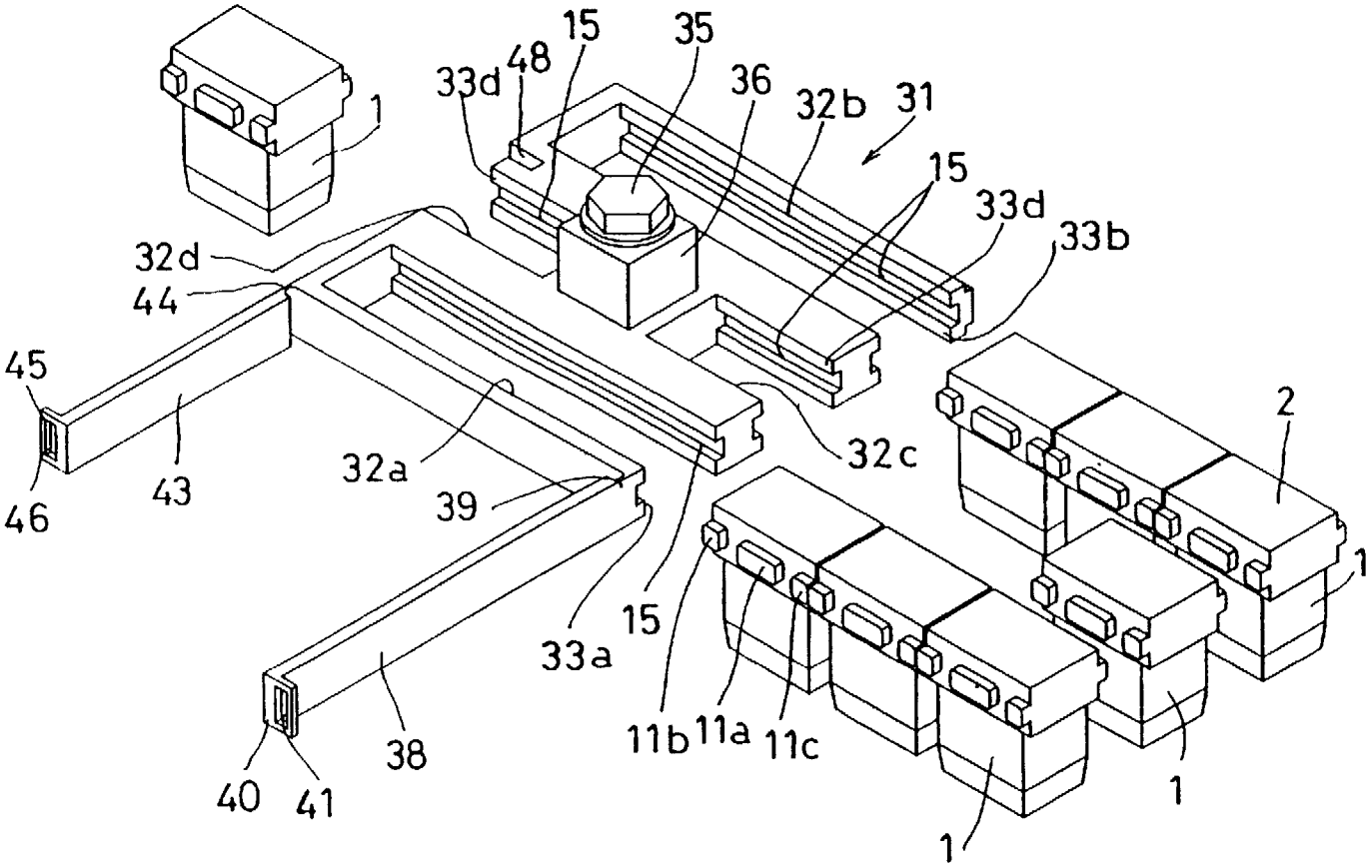
FIG. 9 is a schematic isometric view of a second embodiment showing the pre-assembly state.
Figure 10:
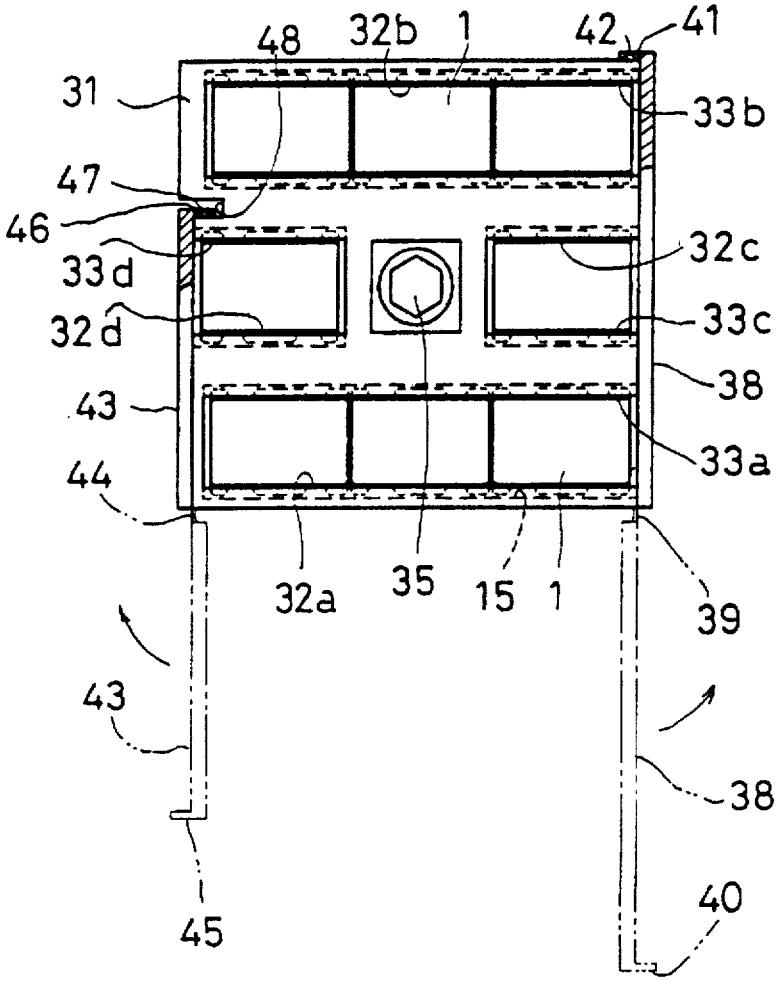
FIG. 10 is a plan view showing the assembly process of the second embodiment.
Figure 11:
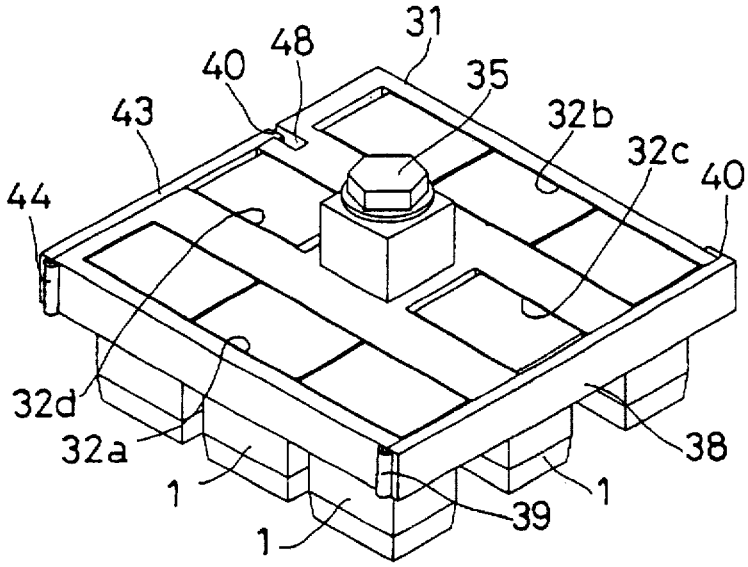
FIG. 11 is a schematic isometric view showing the post-assembly state of the second embodiment.

FIGS. 9 to 11 show a bolt-type connector casing used for female partitioned connectors. This constitutes a second embodiment of the present invention. In the second embodiment, 8 female connectors 1 of the same type as described in the first embodiment are provided.

A planar square shaped frame 31, into which the female connectors 1 are inserted, has insertion channels 32*a* and 32*b* provided along the left and right sides (the upper and lower sides in the case of FIG. 10) respectively. Each of these insertion channels 32*a* and 32*b* allows three female connectors 1 to be inserted sequentially in an upright position into the frame 31. The insertion channels 32*a* and 32*b* have open ends 33*a* and 33*b*. The central portion of the frame 31 has a through member 36 provided for accommodating a bolt 35 which is attached in use to the corresponding male frame (not shown). Insertion channels 32*c* and 32*d* are provided in front of and behind the through hole 36. Each of these channels allows one female connector 1 to be inserted therein as illustrated. Protruding members 11 provided on each end member 2 of each female connector 1 are freely slidable along guiding grooves 15 provided along the two inner side faces of each of the insertion channels 32*a*–32*d*. The guiding grooves 15 are open in the direction of the respective corresponding open ends 33*a*–33*d*.

A first closing plate 38 is attached to be freely movable by means of a self-hinge member 39 to the foremost left hand corner of the frame 34. The first closing plate 38 closes the respective insertion channels 32*a*, 32*b* and 32*c*. A locking plate 40 with a window 41 formed therein is provided for engagement with a locking member 42 that projects outward at the foremost right hand corner of the frame 31. A second similar closing plate 43 is attached to the rearmost left hand corner of the frame 31, and serves to close the insertion channel 32*d* whilst overlapping the closed end of the insertion channel 32*a*. A locking plate 45 with a window 46 is provided on the second closing plate 43 for engagement with a locking member 47 which projects out from a side face of a groove 48 formed between insertion channels 32*b* and 32*d*.

The rearmost portion of the insertion channel 32*b* located on the right extends outward to the extent of the thickness of the second closing plate 43 so that when closed, the plate 43 is flush with the rear of the frame.

A assembly is carried out by opening both the closing plates 38 and 43 (as shown by chain lines in FIG. 10). The specified number of female connectors 1 are inserted into the respective insertion channels 32*a* to 32*d* by sliding the protruding members 11 of each female connector 1 along the guiding grooves 15. Once all the female connectors 1 have been inserted, the closing plates 38 and 43 are closed in the directions indicated by the arrows in FIG. 10. Then, the closing plates 38 and 43 are locked as the windows 41 and 46 of the respective locking plates 40 and 45 lock into the locking members 42 and 47 respectively.

The resulting female partitioned connector casing assembly is fastened to a similarly assembled male partitioned connector casing (not shown) by means of the bolt 35.

The closing plates 38 and 43 are opened, thus allowing each female connector to be pulled out one by one from the open ends of the insertion channels.

In each of the above embodiments, although the number of connectors inserted into the frames are respectively specified as 2 and 8, this is only by way of example and the number of connectors that may be arranged to be inserted may be varied. As mentioned earlier the present invention is not limited to female connectors but is equally useful for male connectors.

The present invention is not limited to the embodiments described above. For example other kinds of register means may be provided to permit sliding engagement of the connectors within the casing. Other kinds of retention detent are possible, and the number of retention dents may be fewer or the detent may be eliminated. Other possibilities lie within the technical range of the present invention. Moreover, the present invention may be embodied in various ways without deviating from the scope thereof.

We claim:

1. An electrical connector assembly comprising a frame defining a frame opening, a closure member hingedly connected to the frame for the frame opening, and a plurality of electrical connectors insertable in the frame through said frame opening, each connector comprising a body having at least one electrical wire protruding therefrom, the frame and connectors having co-operating register members adapted to engage and guide said connectors one by one into said frame, and said closure member retaining a plurality of connectors in said frame when positioned to close said frame opening.

2. An assembly according to claim 1 wherein said register members comprise-a peg of one of the frame and connector, and a groove of the other of the frame and connector.

3. An assembly according to claim 2 wherein said groove is provided in the frame.

4. An assembly according to claim 3 wherein said frame comprises a channel adapted to receive said connectors in series, said channel having opposite longitudinal grooves and said connectors having opposite pegs for engagement in a respective groove.

5. An assembly according to claim 4 wherein said connectors have a plurality of pegs on each side thereof.

6. An assembly according to claim 1 and including a latching member to retain a connector in said frame.

7. An assembly according to claim 6 wherein said latching member comprises a projection of the frame engageable with a detent of a connector.

8. An assembly according to claim 7 wherein said projection engages the register means of said connector.

9. An assembly according to any preceding claim wherein said frame includes an integral cover to shield wires of said connectors.

10. An assembly according to claim 9 wherein said cover has a cover opening co-extensive with said frame opening.

11. An assembly according to claim 1 wherein said frame and closure member are of plastic and said closure member is connected to the frame by a living hinge.

12. An assembly according to claim 11 wherein said closure member includes a latch for engagement with said frame in the closed condition.

13. An assembly according to claim 1 wherein said closure member includes a latch for engagement with said frame in the closed condition.

14. An electrical connector assembly comprising a frame defining a frame opening, a closure member hingedly connected to the frame for the frame opening, and a plurality of electrical connectors insertable in the frame through said frame opening, each connector comprising a body having at least one electrical wire protruding therefrom, the frame and connectors having co-operating register members adapted to engage and guide said connectors one by one into the frame, said closure member retaining a plurality of connectors in said frame when positioned to close said frame opening, and said frame further comprising an integral cover to shield wires of said connectors.

15. An electrical connector according to claim 14 wherein said cover has a cover opening co-extensive with said frame opening.

16. An electrical connector assembly comprising a frame defining a frame opening, a closure member integrally hinged to said frame for movement between positions to open and close the frame opening, a plurality of electrical connectors insertable in the frame through said frame opening, and a fastener operable to draw said frame together with another frame having complementary connectors adapted to electrically couple with said connectors, each connector comprising a body having at least one electrical wire protruding therefrom, the frame and connectors having co-operating register members adapted to engage and guide said connectors one by one into said frame, and said closure member retaining a plurality of connectors in said frame when positioned to close said frame opening.

* * * * *